United States Patent [19]

Huber et al.

[11] Patent Number: 4,776,786

[45] Date of Patent: Oct. 11, 1988

[54] DEVICE AND TECHNIQUE FOR LIGHTING A FLAME IN AN ATOMIC ABSORPTION SPECTROMETER

[75] Inventors: Bernhard Huber; Toma Tomoff, both of Uberlingen, Fed. Rep. of Germany

[73] Assignee: Bodenseewerk Perkin-Elmer, Uberlingen, Fed. Rep. of Germany

[21] Appl. No.: 905,807

[22] Filed: Sep. 10, 1986

[30] Foreign Application Priority Data

Sep. 12, 1985 [DE] Fed. Rep. of Germany ..... 3532537

[51] Int. Cl.[4] ..... F23N 5/20

[52] U.S. Cl. ..... 431/6; 356/315; 431/191

[58] Field of Search ..... 431/6, 191, 192, 263, 431/286; 356/315, 417

[56] References Cited

U.S. PATENT DOCUMENTS

| | | | |
|---|---|---|---|
| 2,046,828 | 7/1936 | Leins et al. | 431/192 |
| 2,078,576 | 4/1937 | Laghetto | 431/192 X |
| 3,052,112 | 9/1962 | Wheeler | 431/191 X |
| 3,298,420 | 1/1967 | Blanzy | 431/191 |

FOREIGN PATENT DOCUMENTS

| | | | |
|---|---|---|---|
| 249612 | 1/1964 | Australia | 431/191 |
| 7033639 | 1/1971 | Fed. Rep. of Germany . | |
| 68981 | 11/1927 | Sweden | 431/191 |
| 481684 | 3/1938 | United Kingdom | 431/191 |

*Primary Examiner*—Randall L. Green

*Attorney, Agent, or Firm*—Ronald G. Cummings; Francis L. Masselle; Edwin T. Grimes

[57] ABSTRACT

A gas conducting tube (12) with a flat end (14) cut off at an angle is pivotal above the burner head 10 for lighting the flame of an atomic absorption spectrometer. Gas emerging from the burner is passed through the tube from the first end 14 to a second end 16 where a glow filament 24 is arranged. The diverted gas is lit and flashes back to the burner, whereby the flame thereof is lit. After the flame has been lit, the tube 12 is rotated out of the area of the burner head 10.

2 Claims, 1 Drawing Sheet

DEVICE AND TECHNIQUE FOR LIGHTING A FLAME IN AN ATOMIC ABSORPTION SPECTROMETER

BACKGROUND AND SUMMARY OF INVENTION

The invention relates to atomic absorption spectroscopy and more particularly to a device and technique for lighting the flame on a burner head in an atomic absorption spectrometer with an incandescent filament.

In atomic absorption spectroscopy, a measuring light beam is generated having a line spectrum identical with the resonant lines of a looked-for element. The measuring light beam is passed through a "cloud of atoms" containing the atoms of the sample to be examined in an atomic state. The atoms of the looked-for element absorb the measuring light beam since their resonant lines are identical with the line spectrum of the measuring light beam while the atoms of other elements do not affect the measuring light beam. Therefore, the absorption of the measuring light beam in the cloud of atoms provides a measure of the quantity of the looked-for elements in the cloud of atoms. The concentration of a looked-for element in a sample can be determined by this method with high sensitivity by reproducible atomization of selected sample quantities and calibration with a known calibration solution.

A flame is used in many cases for atomizing a sample. The sample is burned on a burner with an oblong burner head extending in the direction of the measuring light beam and disposed below the beam. A very hot flame, such as an air-acetylene flame, is generally necessary for atomizing a sample.

A glow filament is used in known devices for lighting the flame in the burner of an atomic absorption spectrometer. The glow filament is attached to an arm and is rotated over the burner. The arm is manually movable. This arm has to accommodate the current supply and therefore has relatively large dimensions. The glow filament is exposed to the hot flame for a short time when the flame is lit and, therefore, the useful life of the glow filament is highly limited.

For lighting a burner, it is also known to use a "pilot-flame" which is a little acetylene jet flame lit by a glow filament. The jet flame then lights the burner. This method is very expensive and requires an additional solenoid valve, an additional gas conduit and a nozzle. Because of the narrow nozzle for the pilot flame, such an arrangement is very sensitive to clogging. Furthermore, the jet flame must neither be too short nor too long so that adjustment is also necessary. The flow at the outlet of the nozzle has to be purposefully disturbed such that acetylene comes into contact with the glow filament.

It is also known to light the burner by a spark generated by means of high-voltage. Such a spark generates strong high frequency disturbances which can be reduced at high costs. In addition, a problem of protection against accidental contact is present with this method of lighting a burner.

It is an object of the present invention to provide an improved apparatus and technique for lighting a flame in a burner of an atomic absorption spectrometer.

Another object of the invention is to provide an apparatus and technique for lighting a burner which avoids overheating of the glow filament by the burner flame.

Another object of the invention is to provide such an apparatus which is economical to manufacture and durable in use.

Other objects will be in part obvious and in part pointed out more in detail hereinafter.

Accordingly, it has been found that the foregoing and related objects and advantages are attained in an atomizer burner assembly of an atomic absorption spectrometer having a burner head for emitting gas to generate an atomizer flame and a glow filament for igniting the gas positioned remote from the burner head. A gas conductor-ignition assembly conducts a portion of the gas emitted from the burner head to the glow filament for ignition to thereby light the burner head to form the atomizer flame. The gas conductor-ignition. assembly comprises a gas conducting body with an inlet end adjacent the burner head and an outlet end adjacent the glow filament so that a portion of the gas from the burner head will pass from the inlet end to the outlet end and thus to the glow filament. This gas is ignited by the glow filament and flashes back to the inlet end and thus to the burner head to light the burner head to form an atomizer flame.

The glow filament itself however is not exposed to the temperature of the hot atomizer flame. After the lighting, the gas conducting body is rotated out the area of the burner where it can not affect the further operation of the burner and no more gas is passed to the glow filament. The gas for conducting the flame from the glow filament to the burner is taken from the gas stream emerging from the burner head. Therefore, no additional means are required for generating a pilot flame.

The invention accordingly consists in the features of construction, combination of elements and arrangement of parts which will be exemplified in the construction hereafter set forth and the scope of the application which will be indicated in the appended claims.

DESCRIPTION OF THE PREFERRED EMBODIMENT

Figure 1:
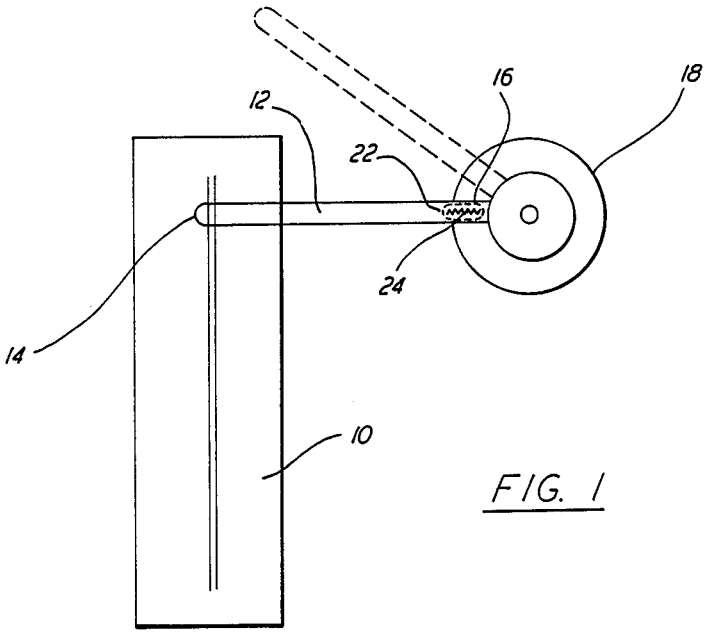
FIG. 1 shows a diagrammatical plan view of the lighting mechanism of the present invention.

Although specific forms of the present invention have been selected for illustration in the drawings, and the following description is drawn in specific terms for the purpose of describing these forms of the invention, the description is not intended to limit the scope of the invention which is defined in the appended claims.

Referring to FIG. 1, the numeral 10 designates the oblong burner head of a burner in an atomic absorption spectrometer. A gas conducting body 12 is provided above the burner head 10 in the form of a thin-walled tube arranged essentially horizontal. The tube 12 has a first inlet end 14 and a second outlet end 16. In the operational position as illustrated in solid lines in FIG. 1, the first end 14 is located above the burner head 10 and the second end 16 is located outside the area of the flame. The second end 16 is mounted to a rotating mounting mechanism 18 which is arranged to rotate the tube 12 between the operational position and a non-operational position out of the area of the burner head 10 as shown in broken lines in FIG. 1. The rotating movement of the tube 12 can be limited by stop means (not illustrated) defining the operational and non-operational positions.

Figure 2:
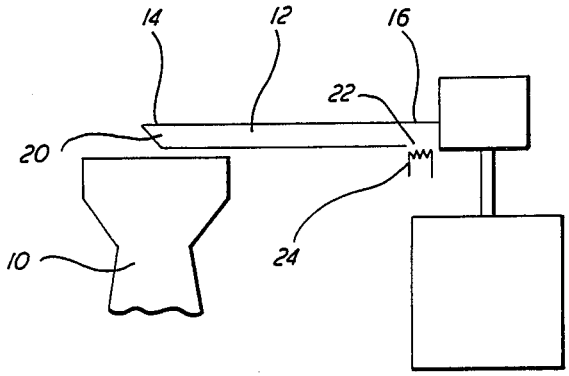
FIG. 2 shows an associated diagrammatical side-elevation view.

As can be seen from FIG. 2, the tube 12 is cut off at an angle at its first end 14 and forms an inclined inlet 20 facing downwards toward the gas outlet 11 of the burner head 10. Because of this shape of the tube, gas emerging from the burner head is passed from the first end 14 to the second end 16. The tube 12 has a gas outlet aperture 22 on the underside of the second end 16 and the glow filament 24 is arranged below this gas outlet aperture 22 in the operating position to ignite the gas flowing outwardly therefrom. The tube 12 is dimensioned and configured so that the ignition flashes back through the tube 12 to ignite the gas emitted from the burner head 10.

In operation, the tube 12 is rotated over the burner head 10 and the glow filament 24 is electrically heated to light the flame. The gas is then switched on and gas flows through the tube 12 to the glow filament 24. There the gas is ignited. The flame flashes back through the tube 12 to the burner head 10 and lights the flame on the burner head 10. The tube 12 then is rotated back to the position of rest shown in broken lines in FIG. 1. The glow filament 24 is switched off.

The rotating mounting mechanism 18 may be a rotary magnet mounting assembly for pivoting the tube 12 between the first and second position. Alternately, a pneumatic actuating drive assembly can be utilized. A particularly advantageous rotating mounting mechanism 18 comprises a bimetal member adopted for response to the heat of the flame such that the gas conducting member is rotated out of the flame after the flame has been lit. In this way, an automatic rotation of the tube 12 out of its operative position to the position of rest is achieved as soon as the burner flame has been lit.

The rotating mechanism 18 can be arranged such that the glow filament 24 is also covered in the position of rest. Therefore dangerous portions are inaccessible for the user and higher-frequency interferences are not produced.

As will be apparent to persons skilled in the art, various modifications and adaptations of the structure above described will become readily apparent without departure from the spirit and scope of the invention, the scope of which is defined in the appended claims.

What is claimed is:

1. A method for lighting the burner head of an atomic absorption spectrometer with a glow filament without subjecting the glow filament to the resulting atomizer flame comprising supplying a high-temperature atomizer-flame-producing gas flow to the burner head of the atomic absorption spectrometer, conducting a portion of the gas flow from the burner head to an area remote from the flame area of the burner head with a gas conductor having an inlet end adjacent the burner head to receive the portion of the gas flow and an outlet end remote from said burner head, igniting the portion of the gas flow at said outlet end at the remote area with the glow filament so as to burn back to said burner head and ignite the gas emitted therefrom to form a high-temperature atomizer flame, and removing the gas conductor inlet end from adjacent the burner head to an area remote from the atomizer flame after ignition of the gas flow.

2. The method of claim 1 wherein the step of removing the gas conductor inlet end from adjacent the burner head after ignition comprises rotating the gas conductor to remove the inlet end of the gas conductor to an area remote from the atomizer flame.

* * * * *